US007878373B2

(12) United States Patent
Lindmayer

(10) Patent No.: US 7,878,373 B2
(45) Date of Patent: Feb. 1, 2011

(54) DISPENSING CAP

(75) Inventor: István Lindmayer, Döbrököz (HU)

(73) Assignee: Mayex USA KFT., Budapest (HU)

( * ) Notice: Subject to any disclaimer, the term of this patent is extended or adjusted under 35 U.S.C. 154(b) by 1127 days.

(21) Appl. No.: 10/553,425

(22) PCT Filed: Apr. 13, 2004

(86) PCT No.: PCT/HU2004/000034

§ 371 (c)(1),
(2), (4) Date: Aug. 2, 2006

(87) PCT Pub. No.: WO2004/092033

PCT Pub. Date: Oct. 28, 2004

(65) Prior Publication Data

US 2006/0266773 A1 Nov. 30, 2006

(30) Foreign Application Priority Data

Apr. 18, 2003 (HU) ..... 0300103 U
Apr. 18, 2003 (HU) ..... 0303380

(51) Int. Cl.
*B67D 3/00* (2006.01)

(52) U.S. Cl. ..... 222/153.13; 222/153.14; 222/511; 222/211; 222/567

(58) Field of Classification Search ..... 222/511, 222/142.7, 230, 313, 336, 349, 449, 491, 222/550, 505, 215, 251, 518, 512, 153.14, 222/207, 153.13, 153.11, 384, 211, 567
See application file for complete search history.

(56) References Cited

U.S. PATENT DOCUMENTS 549,678 A * 11/1895 Miller ..... 222/559
2,083,156 A * 6/1937 McCabe ..... 222/207
3,162,333 A * 12/1964 Davidson ..... 222/207
3,162,334 A * 12/1964 Miller ..... 222/207
3,595,445 A * 7/1971 Buford et al. ..... 222/213
3,733,015 A * 5/1973 Marques ..... 222/570
3,744,675 A * 7/1973 Song ..... 222/153.14
3,746,036 A * 7/1973 Du Bois et al. ..... 137/496
3,752,366 A * 8/1973 Lawrence, Jr. ..... 222/207
4,778,087 A * 10/1988 Desai ..... 222/449

(Continued)

FOREIGN PATENT DOCUMENTS

EP 0 420 561 A1 4/1991

(Continued)

*Primary Examiner*—Kevin P Shaver
*Assistant Examiner*—Donnell Long
(74) *Attorney, Agent, or Firm*—Birch, Stewart, Kolasch & Birch, LLP

(57) ABSTRACT

Dispensing cap for bottles, including a lower mounting part fixed onto a neck of bottle, an upper covering part containing the dispensing parts, such as valve and opening members, sealing elements between the cap and the bottle for gas-proof sealing, an outlet for pouring liquid, a tube support for holding the tube of siphon structure. The dispensing cap is characterized by containing an irreversibly removable fixing member (27). The fixing member is used to prevent push-down of the valve while the cap is intact. It thus prevents dispensing liquid from the bottle. After it is torn off from the upper covering part, however, to permit the dispensing of liquid from the bottle, the fixing member can be readily removed from the cap without opening the cap.

4 Claims, 2 Drawing Sheets

U.S. PATENT DOCUMENTS

Figure 1:
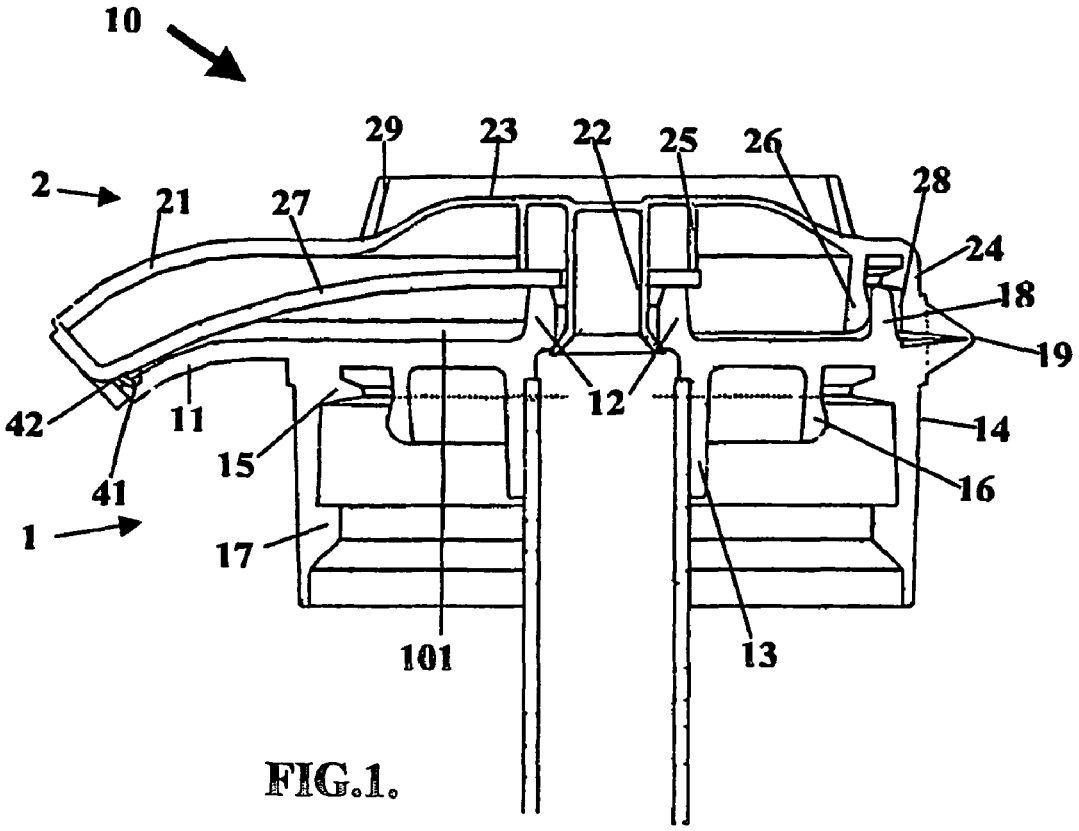

| | | | | | |
|---|---|---|---|---|---|
| 4,795,044 | A * | 1/1989 | Beck | 215/237 |
| 4,974,735 | A * | 12/1990 | Newell et al. | 215/253 |
| 4,995,534 | A * | 2/1991 | Norman | 222/511 |
| 5,037,015 | A * | 8/1991 | Collins | 222/472 |
| 5,299,718 | A * | 4/1994 | Shwery | 222/518 |
| 5,305,930 | A * | 4/1994 | De Laforcade | 222/402.13 |
| 5,447,257 | A * | 9/1995 | Dark | 222/336 |
| 5,505,341 | A * | 4/1996 | Gueret | 222/207 |
| 5,685,444 | A * | 11/1997 | Valley | 215/253 |
| 5,894,962 | A * | 4/1999 | Song et al. | 222/213 |
| 5,918,779 | A * | 7/1999 | Ventura | 222/402.1 |
| 6,036,170 | A | 3/2000 | Pitocco | |
| 6,253,965 | B1 * | 7/2001 | Pitocco | 222/153.07 |
| 6,390,022 | B1 | 5/2002 | Eichler et al. | |
| 6,550,626 | B1 * | 4/2003 | Randall | 215/253 |
| 6,679,403 | B2 * | 1/2004 | Goodall et al. | 222/481.5 |
| 7,040,514 | B2 * | 5/2006 | Colan et al. | 222/402.13 |
| 2006/0043113 | A1 * | 3/2006 | Verespej et al. | 222/153.01 |
| 2007/0263947 | A1 * | 11/2007 | Duquet et al. | 383/96 |

FOREIGN PATENT DOCUMENTS

| | | |
|---|---|---|
| HU | U9200079 | 10/1992 |
| HU | P 210 579 | 5/1995 |
| HU | P 214 254 | 3/1998 |
| HU | U0000054 | 3/2001 |
| WO | WO-95/31398 A1 | 11/1995 |

* cited by examiner

DISPENSING CAP

The subject-matter of the application is a dispensing cap for bottles consisting of a lower mounting part fixed onto neck of bottle, a cover containing the dispensing parts, sealing elements between the cap and the bottle for gas-proof sealing, outlet for pouring liquid, tube support for holding tube, and an irreversibly removable fixing member preventing the dispensing.

There is an endeavor to diminish loss of carbon dioxide content of the rest part of carbonated soft drinks as much as possible to prevent loss of quality. For this purpose plastic dispensing heads similar to those of old soda water bottles are coming into use. The Hungarian patent specification HU 214.254 relates to .a plastic dispensing head closing the bottle dispensing the fluid content and being not higher than a simple screw cap. This solution provides a cheap disposable product for usage once but not protected against repeated usage. A safety ring closing on the neck of bottle torn from the cap at first opening is used to show that the original bottle has been opened. This is not applicable for dispensing heads or caps because they are not taken from the bottle but dispense the liquid. It does not prevent from partial dispensing of liquid but shows unauthorized opening of connection between the bottle and dispensing head.

In the U.S. Pat. No. 6,036,170 is used an foldable arm with an strap in order to actuate the valve. For delivering the carbonated liquid it is first necessary to release the said strap. The strap, however, makes taller the cup, and the foldable arm is delicate for breaking. The outlet's open is closed, and it must break before the first use according to the U.S. Pat. No. 5,894,962. This method does not inhibit direct to actuate the valve assembly, only indirect by the closed opening. The EU.Pat. 0 420 561 let us know a dispensing head solution wherein the actuator element is hinged to the rest of the head. Upon first use, the user will need to exert enough pressure on the actuator element to break the bridge so as to allow the actuator element to be depressed. This last solution does not show enough conspicuous the previous opening for the consumers.

The solution of the present application aims to develop a flat or low dispensing cap for soft drink bottles being sufficiently cheap to be disposable and protecting against unauthorized opening of bottle, as well as partial dispensing of liquid.

The solution is based on the creative recognition that the cap should consist of one part without complementing elements in order to be cheap enough to be disposable. It may be molded or die-cast in a single mold. The mold is complicated causing higher cost once but the assembly cost is reduced.

Another creative recognition establishing the solution is that preventing pressing down the dispensing unit may eliminate unauthorized usage. If the preventing part is taken away the packaged product is obviously not untouched. A further creative recognition is that the lower fixing part on the neck of bottle, the covering part thereon and the fixing member preventing dispensing should be made connectedly as one piece then all envisaged tasks are fulfilled and a new result not following from the state of art is reached.

The inventive solution based on the mentioned recognition is a dispensing cap for bottles consisting of a lower mounting part on the neck of bottle, an upper part comprising the dispensing details such as valve and opening members of bottle, part sealing elements between the cap and the bottle for gas-proof sealing, outlet for pouring liquid, tube support for holding the tube of siphon structure, an irreversibly removable fixing member preventing dispensing, and known completing elements if necessary. The dispensing cap according to this application has the characteristic feature that its outlet consists of an outlet base belonging to the mounting part and an outlet cover belonging to the cover. Furthermore, the opening elements consist of a valve case belonging to the mounting part, and a valve belonging to the cover, wherein the cover is provided with a holding tube surrounding the valve case, but does not reach the upper level of the valve case, the fixing member is in the outlet and having an once breakable joint to the upper outer end of the outlet cover, passing under the holding tube, being supported by the valve case and its—advantageously forked—end surrounds the valve.

The dispensing cap described in the application has the advantageous characteristic feature that the mounting part , the cover; and the fixing member are joined together and assembled into dispensing cap using any known connecting structure, like dowel holes are formed in the mounting part and dowel pins entering the dowel holes are formed in the cover to join permanently together the lower and upper parts of the dispensing cap.

The dispensing cap described in the application has the advantageous characteristic feature that the mounting part comprises a cylindrical shell tightly seating on the neck of bottle having an inwardly directed fixing flange on its lower end, which joins permanently under the outside flange of the neck of bottle after mounting.

The dispensing cap described in the application has the advantageous characteristic feature that the mounting part Is provided with an inwardly directed flange elastically seating from outside to the neck of bottle and a sealing stub entering the mouth of bottle and elastically seating from inside to it.

The dispensing cap described in the application has the advantageous characteristic feature that the mounting part is provided with an upward directed collar on its border seating in the groove formed by the cover wall and the parallel downward directed inner wall.

The dispensing cap described in the application has the advantageous characteristic feature that a diaphragm is shaped by reducing the thickness of the top of cover around the valve and complemented with a projection surrounding it partly or wholly.

The dispensing cap described in the application has the advantageous characteristic feature that the mounting part, the cover, and the fixing member are manufactured as one piece i. e. they are connected in the process of manufacturing.

The invention for which protection is sought is described below using the attached figures but without any limitation to the applicability of the solution or the extent of protection to the shown examples of embodiment.

FIGURES

FIG. 1: Lateral section of an advantageous construction of the dispensing cap according to application.

Figure 2:
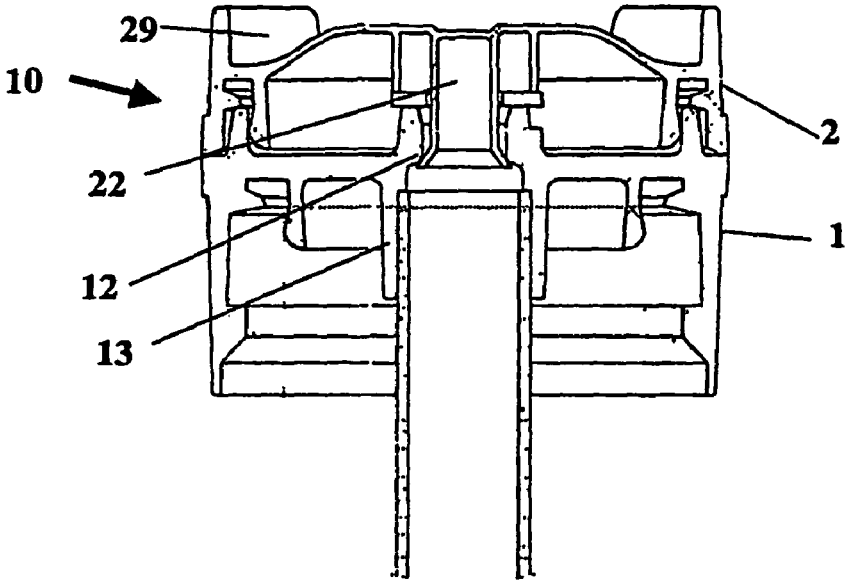

FIG. 2: Section of the dispensing cap shown in the FIG. 1 along II-II.

Figure 3:
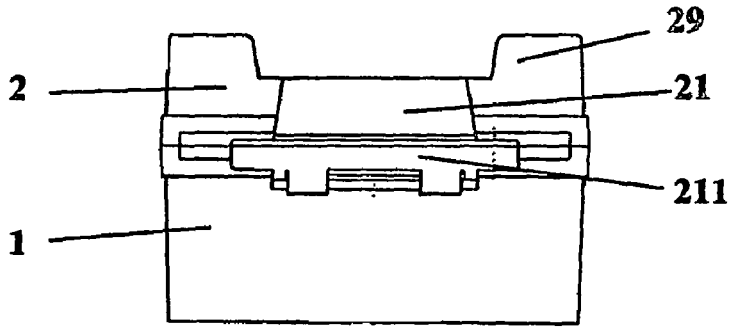

FIG. 3: A simplified view of the dispensing cap shown in the FIG. 1 from the side of outlet.

Figure 4:
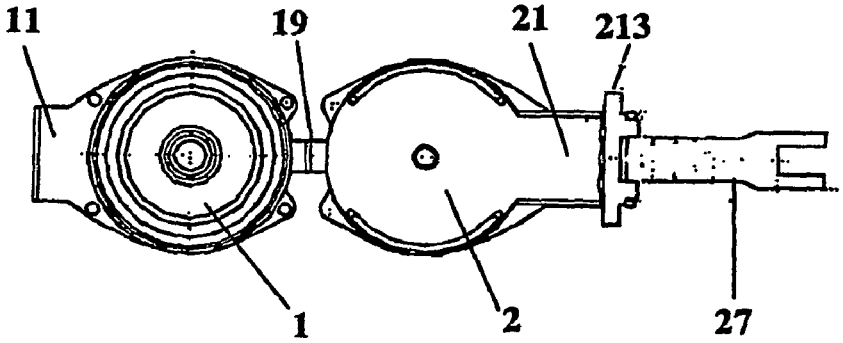

FIG. 4: Schematic drawing of an advantageous embodiment of the dispensing cap according to application in extended state before closing.

Figure 5:
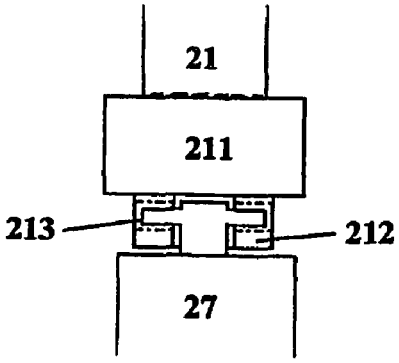

FIG. 5: Schematic drawing of the connection between the cover and the fixing member.

The dispensing cap 10 consists of a mounting part 1 and a cover 2 having a fixing member 27 inside (see FIGS. 1 and 2). The mounting part 1 is substantially a hollow cylindrical body comprising the outlet base 11 for pouring out the liquid and being closed by a disc 101 with a hole in the center. The cover 2 containing the outlet cover 21 is a part completing and closing from above the mounting part 1 (see FIG. 3). As shown, the dispensing cap 10 consists of two connected precisely matching parts. The FIG. 4 shows that parts of the dispensing cap 10 are manufactured connected together as one piece. The mounting part 1 the cover 2 and the fixing member 27 are shown in the FIG. 4 from left to right. The dispensing cap 10 is formed in such a way that the fixing member 27 is folded into the cover 2 then the latter is folded onto the mounting part 1 and fixed. The detailed description is as follows. The mounting part 1 of the dispensing cap 10 has a flange 15 surrounding the neck of bottle and tightly seating from outside on it inside the cylindrical wall 14. A sealing stub 16 being projection of the disc 101 closing the cylindrical wall 14 seats tightly to the neck of bottle from inside. The disc 101 has a circular opening with an upward projection in its center forming a valve case 12 and a valve seat on the lower side. The coaxial to the valve case 12 ring-shaped tube support 13 has larger diameter than the valve case 12 and projects downwards from the disc 101. A fixing flange 17 is in the lower part of the mounting part 1, and the dispensing cap 10 may be permanently fixed onto the bottle by snapping the fixing flange 17 under the circular projection on the neck of bottle. The mounting part 1 is rigidly fixed and positioned on the neck of bottle by the fixing flange 17 the flange 15 and the sealing stub 16. The rigidity should be understood however according to elasticity of plastic.

The cover 2 is connected to the mounting part 1 by a connective piece 19. The connective piece 19 is either a plastic strip designed for folding or any other known foldable part (e. g. a plaited structure). A thin relatively elastic diaphragm 23 shaped by reducing the thickness closes the top of the cover except for a circular ring on its border. A hollow slightly flaring valve 22 coaxial with and precisely fitting to the valve case 12 projects from the center of the diaphragm 23 downward. The flaring lower flange of the valve 22 seats on the valve seat shaped on the lower part of the disc 101. The valve 22 is in elevated position held by the diaphragm 23 and by gas pressure when the bottle is filled with aerated soft drink, its lower flange closes tightly the valve case 12. When the diaphragm 23 is pressed down, the valve 22 moves downwards and opens the valve case 12 to let the liquid out. A rigid projection 29 protrudes on the top of the cover 2 either in three fourth of circle around the diaphragm 23 or at least on both sides of the diaphragm 23 to protect it against unintended pressing down. The main part of the cover 2 is the cover wall 24 having shape of an almost whole circle interrupted only by the outlet cover 21 making the cover wall 24 shorter than a whole circle. The cover 2 has the same thickness in the ring around the diaphragm 23 as the cover wall 24. The inner wall 26 projects from this ring downwards parallel to the cover wall 24 in the cover 2 except for the section of outlet cover 21. The cover wall 24 and the inner wall 26 form a groove 28 receiving the collar 18. This structure connects and tightly binds the mounting part 1 and the cover 2 with labyrinth connection. A holding tube 25 forming a short stub projects from the diaphragm downwards and is supported by the fixing member 27 in the cover 2. The fixing member 27 enters from the outer end of cover 21 up to the center of the cover 2 and its forked end surrounds the valve 22 from three sides above the valve case 12. The fixing member 27 is connected with the outer upper end of the cover 21 through a hinge structure. A flat hinge joint 211 is connected to the outer upper end of the cover 21 along a line. It may be bent relatively to or torn from the cover 21. The hinge joint 212 (see FIG. 5) has rectangular shape with two hinges 212 on the one side. The length of the rectangle is greater than the width of cover 21 and the width of rectangle is equal to the height (quasi height) of the cover opening, and consequently the hinge joint 211 closes the outlet opening. The holes of hinges 212 are on a common straight line. There are hinge bolts 213 on both sides of the one end of the fixing member 27 entering into the holes of the hinges 212 constituting the hinge structure. The other end of the fixing member is enlarged and forms the mentioned forked shape.

When the diaphragm 23 is pressed down the holding tube 25 is stopped by the fixing member 27 and the fixing member 27 is held by the top of the valve case 12 the diaphragm 23 is prevented against pressing down in this way. While the fixing member 27 is in its place the opening of bottle is prevented both at the valve 22 and at the outlet. The hinge joint 211 is broader than the outlet so it may be easily caught from both sides with two fingers. The hinge joint 211 joins the cover 21 along a line with thinned or perforated joint and may be torn without damaging the outlet. When the hinge joint 211 is torn from the end of cover 21 the fixing member 27 may be drawn out and disposed. The dispensing cap 10 may be used not only for closing the bottle but also for dispensing the liquid from it. It is advantageous if the color of the hinge joint 211 is different from that of the cover 2 in consequence thereof it appears obviously that the bottle is not in the original state i.e. it has been already opened and used. The hinge joint 211 being wider than the outlet is however so apparent that it fulfills perfectly this task even having she same color.

The dowel holes 41 on the four points of the mounting part 1 and the dowel pins 42 entering them serve for the safe joint of the mounting part by snapping the latter ones into the dowel holes 41 by hand establishing permanent joint. The number of dowel holes 41 and dowel pins 42 may be increased in reasonable limits according to necessity. The mounting part 1 and the cover 2 may be permanently joined by any other known method without any influence on the extent of protection sought by the present application.

All the three parts of the dispensing cap 10 i. e. the mounting part 1 the cover 2 and the fixing member 27 joined together are advantageously manufactured in a single process using a single mold. The manufacturing process has the advantage that the parts of the dispensing cap are made surely of the same material and all the parameters of manufacturing i. e. temperature, pressure their change in the time and all other ones are the same. Another advantage is that all the parts are received together. It is possible to manufacture separately the parts and assemble them thereafter but the fact that the dispensing cap does not consist of parts occasionally selected from different sets makes the assembly process faster and the reliability and the quality of product higher. Even the assembly process being part of manufacturing becomes easier, faster and more reliable when the connected parts should be folded and snapped together by simple movements. The manufacturing in a single mold makes the dispensing cap so cheap as the cost of any simple cap being unable to dispense. The reuse i. e. the required storage and the demanding and expensive cleaning and disinfection of caps become unnecessary in this way.

Summing up what has been said the invention described in the application relates to a dispensing cap having new characteristic features such as the securing insert and the assembly of upper and lower parts manufactured together in one mold of the dispensing cap.

The dispensing cap described in the application provides solution to the problem completely unsolved up to now in this field, because there has not been any safety device for flat dispensing caps or rather for all types of dispensing caps preventing or indicating dispensing from the original bottle even once or of a small quantity.

The solution according to invention can provide a dispensing cap having small dimensions and a price adequate for the usage once and also largely fulfilling the hygienic requirements.

The invention claimed is:

1. A dispensing cap for bottles, said cap comprising a lower mounting part fixed onto a neck of a bottle, said lower mounting part comprising a cylindrical shell tightly seating on the neck of the bottle, said cylindrical shell having an inwardly directed fixing flange on its lower end which, after mounting, joins permanently to the bottle under an outside flange of the neck of the bottle, an upper covering part containing dispensing parts including valve and opening elements, sealing elements between the cap and the bottle for gas-proof sealing, an outlet for pouring liquid, a tube support for holding a tube of a siphon structure, and an irreversibly removable fixing member preventing dispensing, wherein the lower mounting part is provided with an upwardly directed collar on its border, said collar seating in a groove formed by a cover wall of the upper covering part and a downwardly directed inner wall of the upper covering part extending in parallel to said cover wall, wherein said outlet comprises an outlet base belonging to the lower mounting part and an outlet cover belonging to the upper covering part, and wherein the opening elements comprise a valve case belonging to the lower mounting part, and a valve belonging to the upper covering part, wherein the upper covering part is provided with a holding tube surrounding the valve, but not reaching the top of the valve case, and wherein the fixing member is arranged in the outlet and comprises a once-breakable joint to the upper outer end of the outlet cover, said fixing member extending under the holding tube and being supported by the valve case, and its free end being fork-shaped to partly surround the valve, and wherein the lower mounting part, the upper covering part, and the fixing member are joined together and assembled into a dispensing cap by using dowel holes formed in the lower mounting part and dowel pins entering the dowel holes that are formed in the upper covering part to join permanently together the lower and upper parts of the dispensing cap.

2. The dispensing cap according to claim 1, wherein the lower mounting part further comprises an inwardly directed flange elastically bearing from outside the bottle against the neck of the bottle, and a sealing stub extending into the mouth of the bottle and elastically bearing from inside the bottle against the neck of the bottle.

3. The dispensing cap according to claim 1, wherein a diaphragm is formed in the upper covering part by reducing the thickness of the top of the upper covering part above the valve, said diaphragm being partly or wholly surrounded by a projection of the upper covering part.

4. The dispensing cap according to claim 1, wherein the lower mounting part, the upper covering part, and the fixing member are connected in the process of manufacturing to constitute a single piece.

* * * * *